United States Patent [19]

Yokota et al.

[11] 3,952,571

[45] Apr. 27, 1976

[54] METHOD OF MANUFACTURING ALUMINUM CONDUCTOR WIRES

[75] Inventors: Minoru Yokota; Ken-Ichi Sato, both of Osaka; Takenobu Higashimoto, Yokohama, all of Japan

[73] Assignee: Sumitomo Electric Industries, Ltd., Osaka, Japan

[22] Filed: Jan. 30, 1975

[21] Appl. No.: 545,693

[30] Foreign Application Priority Data

Feb. 12, 1974 Japan ..... 49-17334

[52] U.S. Cl. ..... 72/286; 148/11.5 R

[51] Int. Cl.[2] ..... B21C 9/00

[58] Field of Search ..... 72/274, 278, 286; 29/DIG. 2, DIG. 11; 148/11.5 R

[56] References Cited

UNITED STATES PATENTS

| | | | |
|---|---|---|---|
| 1,178,863 | 4/1916 | Lauber et al. | 148/11.5 A |
| 1,931,913 | 10/1933 | Ennor | 148/11.5 A |
| 2,670,309 | 2/1954 | McClintock | 148/11.5 A |
| 3,663,216 | 5/1972 | Hunsicker | 148/11.5 A |
| 3,716,419 | 2/1973 | Boutin | 148/11.5 A |
| 3,807,016 | 4/1974 | Schoerner | 148/11.5 A |
| 3,826,690 | 7/1974 | Bleinberger et al. | 72/286 |

*Primary Examiner*—Milton S. Mehr

*Attorney, Agent, or Firm*—Carothers and Carothers

[57] ABSTRACT

The present invention relates to a method of manufacturing aluminum wires for communication cables, insulated electric wires, etc., from aluminum for electrical purposes or as an aluminum alloy for electric conductors containing various additive elements, which is characterized in that cold working of 80% or more is given to the product after hot working, then low temperature intermediate annealing is carried out at a temperature of 100° – 280°C, then cold drawing of 50% or more is given and a continuous annealing is carried out. A manufacturing method is thus provided for aluminum wires for communication cables, insulated electric wires, etc., having excellent overall properties of strength, electrical conductivity, ductility, etc., which is suitable for the modernized high-speed manufacturing line and which is superior with respect to productivity and workability.

2 Claims, 2 Drawing Figures

METHOD OF MANUFACTURING ALUMINUM CONDUCTOR WIRES

BACKGROUND OF THE INVENTION

The present invention relates to a method of manufacturing aluminum conductor wires. More particularly, it relates to a method of manufacturing aluminum wires for communication cables which have excellent mechanical and electrical properties.

In the past, copper wires were exclusively used as conductors for communication cables, conductors for insulated electric wires, and the like. However, the rise and fluctuations of the price of copper throughout the world in recent years caused by the instability of the supply system of copper have prompted the transition from copper to aluminum and the movement to the use of aluminum wires and aluminum alloy wires for such conductors has rapidly come about.

Under the circumstances, the aluminum wires and aluminum alloy wires used for these purposes have come to be required to possess properties equal to those that have been possessed by copper wires used in the past.

Plastic-insulated communication cables using copper for their conductors are usually manufactured by the steps shown in FIG. 1(a).

Of these steps, the steps (A) through (E) make up a completely tandemized line, with the drawing machine, continuous annealing machine, extruder, cooling pipe and take-up machine arrayed in series. This manufacturing line is commonly referred to as the tandemized line for communication cables. Several hundreds or several thousands of wires manufactured in this way are stranded together to be completed as the so-called communication cable, so that an exceedingly high productivity is naturally required of this tandemized line. In order to realize the use of aluminum for communication cables, therefore, it is indispensable to develop an aluminum material and a manufacturing method which are suitable for this modernized continuous manufacturing line.

Compared to copper, aluminum generally has a strength of about one-third and an electrical conductivity of about 60%. This lower electrical conductivity can be compensated for by increasing the diameter of the conductor, but this will not be entirely satisfactory from the view-point of strength.

If the object is merely to improve strength, then it is conceivable to omit the continuous annealing step, i.e., step (B) in the manufacturing line of FIG. 1(a) and use it as a completely hard material, or to add a complete annealing step at 300° to 400°C before the step (A) of the manufacturing line of FIG. 1(a) and instead omit the continuous annealing of step (B), thus using it as a ¾ H material.

However, the properties required of communication cables are not only strength. At the time of manufacture, burying, jointing, and installation, they are required to have sufficiently good properties of elongation, resistance to bending, flexibility, etc. Furthermore, as inherent requirements of communication cables, satisfactory properties with respect to mutual capacitance, capacitance unbalance, cross-talk, attenuation, etc., are also required.

The conventional manufacturing method of FIG. 1(b) will now be described in further detail. In manufacturing the wire, usually a supply wire of a diameter of approximately 2 mm drawn by a breakdown machine is drawn by the drawing machine of the tandemized line (Step (A) in FIG. 1(b)) to a final size or a size about 10 to 30% larger in cross-sectional area than the final size. This wire is subjected to the continuous annealing machine (Step (B) in FIG. 1(b)) and made a ¼ H material, after being further drawn by a following 1-die drawing machine when necessary. Before and after this continuous annealing machine, it is a common practice to provide a trough for washing off the drawing lubricant and to provide a cooling trough. In the meantime, the conductor is subjected to bending of at least 10-odd turns by going through guide rollers or the like. Then the conductor is further subjected to the plastics extruder and goes through the cooling pipe which is as long as 10 to 20 m. It is taken up by a take-up machine after going through dancer rollers, tension helpers (self-driving rollers), etc. During these steps the conductor usually comes to have a total extension of 20 to 100 m (depending on the design and arrangement of the apparatus, number of turns wound on dancer rollers, etc.), and it is subjected to a bending of several tens of turns. Communication cables having copper conductors are also manufactured generally by similar manufacturing steps. If aluminum conductors are used, however, still greater consideration has to be paid to the trough for washing off the lubricant, continuous annealing machine, etc., so that the manufacturing line inevitably becomes longer and more complicated. Perhaps this will easily be understood from the following well-known facts.

Compared to copper, the phenomenon of sticking at the time of drawing is more liable to take place with aluminum, so that a lubricant of a high viscosity which is different from that used on copper is required. In addition, fine dust is exceedingly liable to be produced when drawing aluminum. Also, the oxide film formed on the surface of aluminum makes electric continuous annealing extremely difficult.

Furthermore, the substantial differences between copper and aluminum used as conductors is evidently noticeable even in the wire-setting work conducted at the start of manufacture. Ordinarily, the supply wire of a diameter of about 2 mm has a tensile strength of approximately 45 $Kg/mm^2$ in the case of copper, and approximately 18 $Kg/mm^2$ in the case of aluminum for electrical purposes. However, if this conductor is drawn by the drawing machine of a tandemized line to a desired size (about 0.3 – 0.8 mm in most cases for communication cables), copper is hardened only about 2 – 3 $Kg/mm^2$, as seen from the property of work-hardening by drawing shown in FIG. 2, while aluminum and aluminum alloys become hardened to as much as about 10 $Kg/cm^2$ and show a remarkable degradation in elongation, becoming exceedingly brittle. Usually the continuous annealing machine is not put into operation at the time the wire-setting work is done. As much as several tens of meters of this brittle conductor has to be conveyed to the take-up machine after receiving repeated bending work for several tens of times. This requires very careful attention and skill in comparison to that required in the case of a copper conductor. That is to say, a flexibility which can withstand the repetition of bending work is strongly demanded for the wire-setting operation at the commencement of manufacture.

Next, an important property required at the time of manufacture is strength against line tension. This is a requirement that must be said to be quite natural if it is considered that the conductor has to travel through the tandemized line having a total length of several tens of meters as already described at a speed of several hundreds of meters per minute, passing through the cooling trough, washing trough, plastics extruder, etc. More particularly, the smaller the conductor size is, the more important this property becomes.

In the course of making a cable of strands manufactured in the above-described way, properties for easy handling, such as flexibility and resistance to bending, becomes necessary again. A hardness of a suitable degree will also become necessary at the time of conductor pointing and splicing.

On the other hand, the properties of conductors are of extreme importance also from the viewpoint of the requisite properites of communication cables. In the case of communication cables, several hundreds or several thousands of individual strands are stranded together to complete one cable. It is well known that the condition of this stranding of strands has a great influence on the quality of the communication cable, especially capacitance unbalance inside quads and cross-talk inside quads. That is to say, if the conductors have a high rigidity and the adaptability among individual strands is poor, the capacitance unbalance inside quads becomes remarkably degraded and the use of aluminum in place of copper will become meaningless.

For the reasons mentioned above, the properties which aluminum is required to possess at the present time to meet the manufacturing conditions and the requirements of communication cables are said to be as follows: If the diameter of the completed conductor is 0.8 mm. then tensile strength should be 9.5 Kg/mm$^2$ or more, elongation 3% or more, electrical conductivity 61.0% or more. If the conductor is of a comparatively small size such as 0.65 mm, 0.5 mm, etc., tensile strength should be 12.0 Kg/mm$^2$ or more, elongation 3% or more, and electrical conductivity 60.0% or more.

These requisite properties are the properties equivalent to those of the so-called ¼ H material, and it is possible to satisfy these properties by giving a cold working of about 20% after continuous annealing or by using some suitable aluminum alloy in place of aluminum for electrical purposes. As has already been mentioned, however, the wire setting operation at the commencement of manufacture or at the time of wire breaking is extremely difficult. This has been a big obstacle in blocking the way to mass production of communication cables of aluminum conductors.

The measure that has been generally taken in the case where the material is subjected to intense working and becomes brittle as mentioned above is to give the material an intermediate annealing treatment at about 300° to 500°C after a suitable working, thereby making it a soft material and thereby preventing it from becoming brittle. The present inventors also carried out an intermediate annealing in a similar way after a cold working of about 90% to make the material a soft material and then manufactured communication cables of aluminum conductors by the steps shown in FIG. 1(b). It was then found that although an improvement was observed in workability, the overall properties of strength, elongation and electrical conductivity were remarkably lower than those of the conductors manufactured without the intermediate annealing and were not in conformity with the aforementioned property requirements.

SUMMARY OF THE INVENTION

An object of the present invention is to provide a method of manufacturing aluminum wires for communication cables, insulated electric wires, etc. which is improved with respect to the aforementioned shortcomings in the prior art in properties and is suitable for the modern tandemized manufacturing line for communication cables and which is excellent with respect to productivity and workability.

Another object of the present invention is to provide a method for manufacturing aluminum wires for communication cables, insulated electric wires, etc., which have excellent overall properties such as strength, electrical conductivity and ductility.

The present invention relates to a method of manufacturing aluminum wires for communication cables, insulated electric wires and the like of ordinary aluminum for electric purposes or aluminum alloys for electric conductors containing various additive elements, wherein cold working of 80% or more is carried out after hot working, followed by low temperature intermediate annealing done at 100° to 280°C, then cold drawing of 50% or more followed by continuous annealing.

The method of manufacturing aluminum wires for electric conductors according to the present invention is further characterized in that cold drawing of 10 to 30% is also carried out after the aforesaid step of continuous annealing if necessary or desired.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE INVENTION

Figure 1:
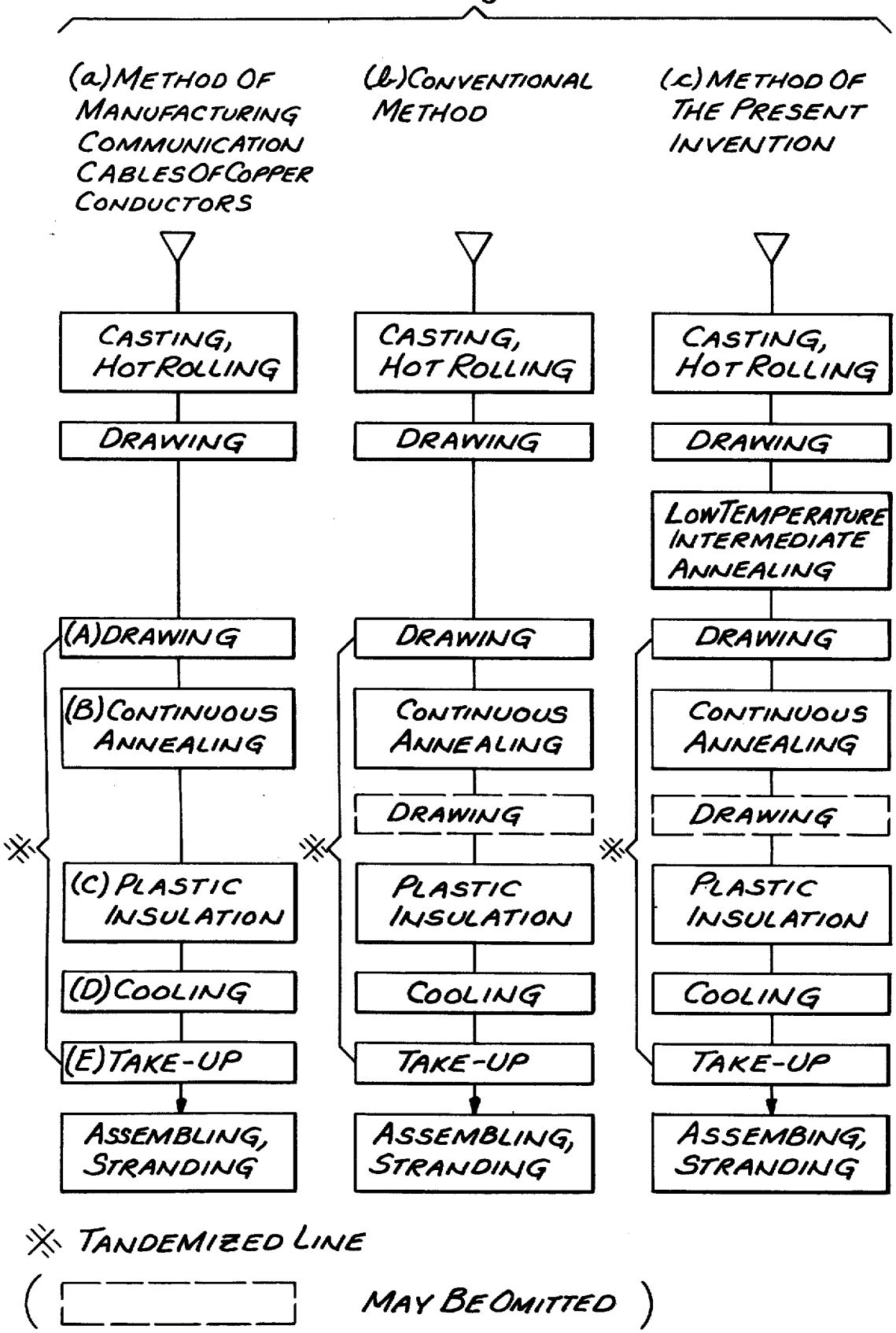
FIG. 1 consists of a series of flow charts showing three manufacturing processes of plastic-insulated communication cables according to conventional methods and the method of the present invention. The flow chart of FIG. 1(a) illustrates a method of manufacture heretofore employed for copper conductor communication cables. The flow chart of FIG. 1(b) illustrates a method of manufacturing aluminum conductors heretofore employed, and the flow chart of FIG. 1(c) illustrates the manufacture of aluminum conductors according to the method of the present invention.
Figure 2:
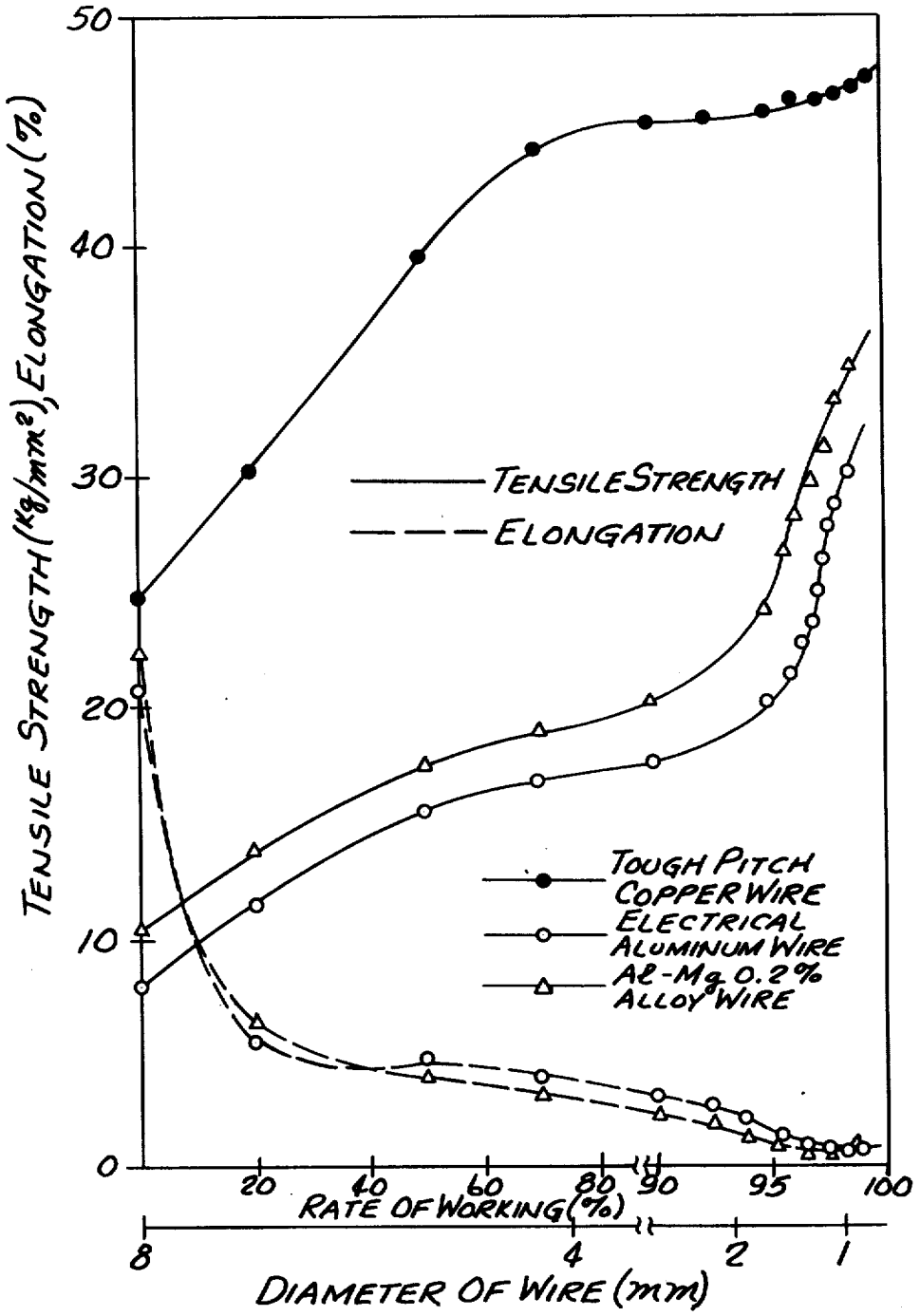
FIG. 2 is a graphic illustration showing the property of work hardening by cold drawing for tough pitch copper and aluminum for electrical purposes and also for Al - 0.2% Mg alloy used in one illustration of the method of the present invention.

FIG. 1(c) shows an example of the manufacturing process according to the teachings of the present invention, wherein plastic-insulated communication cables are manufactured by manufacturing aluminum wires for electric conductors by the method of the present invention, then providing a plastic insulating covering to the wires so manufactured, and thereafter assembling and stranding a number of said insulated wires.

The reason why the material to be used in the present invention is specified to be aluminum for electrical purposes or aluminum alloys for electrical conductors is that the properties required of aluminum wires for communication cables is an electrical conductivity of 60% IACS at the lowest, and this requirement has to be satisfied. Therefore, as long as the electrical conductivity falls within a range wherein 60% IACS can be guaranteed, it is quite permissible for the material to contain other elements such as Fe, Cu, Mg, Si, Ni, Co, Be, Sb, Zr, Y, Sc, rare earth elements, Ag, Cd, Ca, Ge, Bi, In, Sn, Zn, Nb, Mo, Ti, V, etc.

The reason why the degree of working before the low temperature intermediate annealing step is specified to be 80% or more as already mentioned is that if it is less than 80%, the said subsequent low temperature intermediate annealing step will not effect sufficient recovery, while on the other hand, when judged from the viewpoint of the manufacturing processes of communication cables of aluminum conductors, it brings about no advantage at all from the viewpoint of productivity to carry out the low temperature intermediate annealing step after a working of less than 80%.

The reason why the temperature for the aforementioned low temperature intermediate annealing after cold working is specified to be 100° to 280°C is that if the temperature is below 100°C, it shows little recovery of the work-strain and electrical conductivity, it displays little ductility after subsequent cold working and has a poor workability, while a temperature above 280°C improves workability but remarkably degrades its properties after the cold working of 50% or more and continuous annealing are given in subsequent steps.

The reason why the degree of cold working after the aforementioned low temperature intermediate annealing is specified to be 50% or more is that the strength after the aforementioned continous annealing is not sufficient if the degree of cold working is less than 50%.

For the subsequent continuous annealing, any of the commonly used methods of continuous annealing, such as the electric charge heating method, low frequency induction heating method, atmosphere heating method, contact heating method, etc., may be used.

In case it is found difficult to manufacture a material of the desired strength by using the selected final continuous annealing method, it is then desirable that further cold working of about 10 to 30% be performed, as required, to obtain the desired properties.

Now the present invention will be explained in further detail, with reference to examples of embodiment (and examples for comparison).

EXAMPLE 1

99.8% aluminum for electrical purposes having a composition of other elements as shown in Table 1 was cast into an ingot of 150 cm × 150 cm × 1800 cm by the usual melting and semi-continuous casting, and rolled into a wire rod of 9.5 mm diameter by hot rolling. Then it was drawn into a wire of 2 mm diameter by cold working (reduction: 95.5%). The results of analysis of this specimen are shown in Table 1.

Different specimens of this wire were worked upon under various conditions as shown in Table 2. That is to say, different portions of the wire having this diameter of 2 mm were respectively given annealing at various temperatures for various lengths of time. Then, they were given cold working, several kinds of draft being respectively selected, and then given continuous annealing by electric charge heating. For this continuous annealing, electric current, voltage and line speed were adjusted so as to make the elongation 15% or more. After that, it was given cold drawing of about 13% to make aluminum wire of ¼ H material. The wire was then insulated with a plastic. The line speed in this case was 500 m/min.

Table 1

| Fe (%) | Si | Cu | Mn | Ti | V |
|---|---|---|---|---|---|
| 0.11 | 0.05 | 0.001 | 0.002 | 0.0003 | tr. |

Table 2

| | No. | Conditions for Annealing at 2.00 mm diameter Temp. (°C) | Time (Hr) | Cold Working after annealing (%) |
|---|---|---|---|---|
| Ex. | 1 | 130 | 10 | 85 |
| of | 2 | 150 | 5 | 85 |
| Pres | 3 | 180 | 5 | 85 |
| Inv. | 4 | 200 | 5 | 85 |
| | 5 | 230 | 2 | 85 |
| Ex. | 6 | None | None | 85 |
| for | 7 | 300 | 5 | 85 |
| Comp. | 8 | 350 | 5 | 85 |
| | 9 | 150 | 5 | 30 |

The electric conductivity, elongation (gauge length: 250 mm) and tensile strength of the specimens of aluminum wire manufactured under the above-mentioned conditions were measured and their workability during the manufacture was also appraised. Some of the results obtained are shown in Table 3.

All of the measurement results are mean values for $n$ (number of measurements) = 5.

Table 3

| | No. | Properties at 2.0 mm diameter: Tensile Strength (Kg/mm²) | Electric Conductivity (% IACS) | Elongation (%) | Properties of Cable-strand: Tensile Strength (Kg/mm²) | Electric Conductivity (% IACS) | Elongation (%) | Workability |
|---|---|---|---|---|---|---|---|---|
| Ex. | 1 | 19.5 | 62.2 | 1.6 | 10.6 | 62.6 | 7.6 | Δ |
| of | 2 | 18.6 | 62.4 | 1.7 | 10.5 | 62.7 | 6.8 | O |
| Pres. | 3 | 16.2 | 62.6 | 1.4 | 10.5 | 62.8 | 9.4 | O |
| Inv. | 4 | 15.1 | 62.9 | 1.5 | 10.2 | 62.7 | 8.7 | O |
| | 5 | 14.2 | 62.8 | 1.8 | 10.0 | 62.6 | 8.5 | O |
| Ex. | 6 | 21.7 | 62.0 | 1.4 | 10.6 | 62.5 | 7.0 | X |
| for | 7 | 9.7 | 62.2 | 29.3 | 8.3 | 62.4 | 8.4 | O |
| Comp. | 8 | 9.0 | 62.0 | 27.6 | 8.0 | 62.2 | 7.6 | O |
| | 9 | 18.6 | 62.4 | 1.7 | 7.0 | 62.6 | 7.0 | O |

Notes: O: Workability at the time the manufacture is started and for wire setting at the time of wire breaking — Good Table 3-continued

| No. | Properties at 2.0 mm diameter: Tensile Strength (Kg/mm²) | Electric Conductivity (% IACS) | Elongation (%) | Properties of Cable-strand: Tensile Strength (Kg/mm²) | Electric Conductivity (% IACS) | Elongation (%) | Workability |
|---|---|---|---|---|---|---|---|
| Δ: | | " | | | Fair | | |
| X: | | " | | | Poor and manufacture difficult | | |

EXAMPLE 2

Using aluminum alloy wires of the composition of elements shown in Table 4 (the balance of course being aluminum) manufactured in the same way as in Example 1, wire rods of a 2.0 mm diameter were manufactured under the same manufacturing conditions as in Example 1 and then strands for communication cables were manufactured from them under the same manufacturing conditions as shown in Table 2. Some of the results obtained are shown in Table 5.

Table 4

| Type Alloy | Fe(%) | Mg | Cu | Ni | Be | Si | Mn | Ti | V |
|---|---|---|---|---|---|---|---|---|---|
| A | 0.20 | 0.1 | 0.1 | 0.03 | 0.02 | 0.06 | 0.003 | 0.0005 | 0.0005 |
| B | 0.25 | 0.1 | 0.001 | 0.03 | 0.02 | 0.07 | 0.003 | 0.0005 | 0.0005 |

Table 5

| | No. | Properties at 2.0 mm diameter: Tensile Strength (Kg/mm²) | Electric Conductivity (% IACS) | Elongation (%) | Properties of Cable strand: Tensile Strength (Kg/mm²) | Electric Conductivity (% IACS) | Elongation (%) | Workability |
|---|---|---|---|---|---|---|---|---|
| Ex. | A-1 | 22.4 | 59.0 | 1.2 | 14.3 | 60.9 | 9.6 | Δ |
| | B-1 | 21.6 | 59.5 | 1.4 | 14.0 | 61.2 | 8.7 | Δ |
| of | A-2 | 20.3 | 59.6 | 1.6 | 14.0 | 61.1 | 7.9 | O |
| | B-2 | 19.3 | 60.0 | 1.4 | 13.6 | 61.3 | 7.6 | O |
| Pres. | A-3 | 18.6 | 60.8 | 1.4 | 13.9 | 61.4 | 8.7 | O |
| | B-3 | 18.0 | 61.2 | 1.3 | 13.3 | 61.5 | 7.2 | O |
| Inv. | A-4 | 17.6 | 61.4 | 1.4 | 13.6 | 61.5 | 8.5 | O |
| | B-4 | 16.3 | 61.6 | 1.2 | 13.7 | 61.4 | 7.7 | O |
| | A-5 | 17.0 | 61.2 | 1.2 | 13.3 | 61.4 | 7.9 | O |
| | B-5 | 14.3 | 61.4 | 1.1 | 12.9 | 61.3 | 6.9 | O |
| Ex. | A-6 | 24.7 | 58.6 | 1.0 | 14.5 | 60.5 | 8.0 | X |
| | B-6 | 23.4 | 59.0 | 1.1 | 14.1 | 60.8 | 7.9 | X |
| for | A-7 | 12.4 | 61.0 | 21.6 | 13.0 | 60.5 | 8.7 | O |
| | B-7 | 12.0 | 61.3 | 23.6 | 12.4 | 60.6 | 7.2 | O |
| Comp. | A-8 | 11.8 | 60.9 | 20.3 | 12.5 | 60.4 | 6.8 | O |
| | B-8 | 11.5 | 61.1 | 23.2 | 12.0 | 60.3 | 7.3 | O |
| | A-9 | 20.3 | 59.6 | 1.6 | 11.8 | 61.2 | 7.4 | O |
| | B-9 | 19.3 | 60.0 | 1.4 | 10.9 | 61.3 | 5.8 | O |

Notes:
For example, A-1, indicates that the alloy A was manufactured under the manufacturing conditions of No. 1 shown in Table 2.
O: workability good
Δ: workability fair
X: workability poor As is clear from the aforementioned examples, the present invention relates to a method of manufacturing aluminum wires for communication cables, insluated electric wires, etc., from aluminum for electrical purposes or aluminum alloys for electric conductors containing various additive elements or impurities, wherein cold working of 80% or more is given after hot working, then a low temperature intermediate annealing at 100° to 280°C is carried out, followed by further cold working of 50% or more, and then carrying out continous annealing, thereby providing aluminum wires which are excellent with respect to strength, ductility and electrical conductivity. In addition, the manufacturing method of the present invention is most suitable for high speed tandemized production equipment, so that its value for industrial applications is exceedingly high.

We claim:

1. A method of manufacturing aluminum wires for communication cables, insulated electric wires and the like from an initial work material of aluminum for electrical purposes or an aluminum alloy for electrical conductors containing various additive elements, comprising the steps of hot working the initial work material, then cold working the material 80% or more, then applying a low temperature intermediate annealing treatment to the material at 100°C to 280°C, then further cold drawing the material 50% or more, and then continuously annealing the worked material.

2. The method of manufacturing aluminum wires for electrical conductors as claimed in claim 1, which is characterized by the step of cold drawing the material 10 to 30% after the step of continuous annealing is carried out.

* * * * *